US011440763B2

(12) United States Patent
Akiyama

(10) Patent No.: US 11,440,763 B2
(45) Date of Patent: Sep. 13, 2022

(54) AUTOMATIC DOCUMENT FEEDER AND IMAGE PROCESSING APPARATUS

(71) Applicant: TOSHIBA TEC KABUSHIKI KAISHA, Tokyo (JP)

(72) Inventor: Masashi Akiyama, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 162 days.

(21) Appl. No.: 16/898,615

(22) Filed: Jun. 11, 2020

(65) Prior Publication Data

US 2021/0122599 A1 Apr. 29, 2021

(30) Foreign Application Priority Data

Oct. 28, 2019 (JP) ..... JP2019-195034

(51) Int. Cl.
*B65H 31/24* (2006.01)
*B65H 29/60* (2006.01)

(52) U.S. Cl.
CPC ..... *B65H 29/60* (2013.01); *B65H 31/24* (2013.01); *B65H 2511/10* (2013.01)

(58) Field of Classification Search
CPC ..... B65H 29/60; B65H 31/24; B65H 31/30; B65H 31/36; B65H 2405/11162
See application file for complete search history.

(56) References Cited

U.S. PATENT DOCUMENTS

| | | | | |
|---|---|---|---|---|
| 6,045,127 | A * | 4/2000 | Fukui | B65H 39/11 271/303 |
| 7,547,015 | B2 * | 6/2009 | Lee | B65H 31/20 271/213 |
| 8,678,368 | B2 * | 3/2014 | Yoshida | B65H 31/02 270/58.13 |
| 9,242,827 | B2 * | 1/2016 | Niimura | B65H 31/22 |
| 2014/0103603 | A1 * | 4/2014 | Horita | B65H 5/062 271/171 |
| 2016/0127590 | A1 * | 5/2016 | Hatayama | B65H 5/06 358/498 |

FOREIGN PATENT DOCUMENTS

| | | | | |
|---|---|---|---|---|
| JP | 07-244408 | | 9/1995 | |
| JP | 2006-203562 | | 8/2006 | |
| JP | 2007176676 | A * | 7/2007 | |
| JP | 2020156002 | A * | 9/2020 | B65H 31/26 |

* cited by examiner

*Primary Examiner* — Howard J Sanders
(74) *Attorney, Agent, or Firm* — Amin, Turocy & Watson, LLP

(57) ABSTRACT

According to one embodiment, provided is an automatic document feeder including a conveying unit, a first tray, a storage unit, and a paper discharge guide. The conveying unit is configured to convey paper to the paper discharge tray. The first tray is a paper discharge tray on which paper discharged by the conveying unit is stacked. The storage unit is a groove-shaped hole provided below the first tray. The paper discharge guide is a member for guiding paper having a predetermined size discharged by the conveying unit to the storage unit.

18 Claims, 18 Drawing Sheets

AUTOMATIC DOCUMENT FEEDER AND IMAGE PROCESSING APPARATUS

CROSS-REFERENCE TO RELATED APPLICATION

This application is based upon and claims the benefit of priority from Japanese Patent Application No. 2019-195034, filed Oct. 28, 2019, the entire contents of which are incorporated herein by reference.

FIELD

Embodiments described herein relate to generally to an automatic document feeder, an image processing apparatus, and methods related thereto.

BACKGROUND

In an automatic document feeder of the related art, a paper discharge tray on which discharged documents are stacked is provided below a document tray on which a document is set. However, a gap between the document tray and the paper discharge tray is not sufficient. Therefore, in the case of a document having a small size such as a business card which is typically smaller than B5 size of Japanese Industrial Standards and is often sized in an aspect of 55 mm×91 mm in Japan, there is a problem in that it is difficult to pick up a document that is discharged and stacked in the vicinity of a terminal of the paper discharge tray. In addition, since small documents are light, the documents are dispersed on a stacking tray during being discharged due to a discharge force, and thus there is a problem in workability in that a user has to align the documents.

DETAILED DESCRIPTION

Embodiments provide an automatic document feeder that can allow a user to easily pick up a discharged document having a business card size from a paper discharge tray.

In general, according to one embodiment, there is provided an automatic document feeder including a conveying unit, a first tray, a storage unit, and paper discharge guide. The conveying unit is configured to convey paper to the paper discharge tray. The first tray is a paper discharge tray on which paper discharged by the conveying unit is stacked. The storage unit is a groove-shaped hole provided below the first tray. The paper discharge guide is a member for guiding paper having a predetermined size discharged by the conveying unit to the storage unit.

Hereinafter, embodiments will be described.

First Embodiment

First, an image forming apparatus 1 including an automatic document feeder 2 according to a first embodiment will be described.

Figure 1:
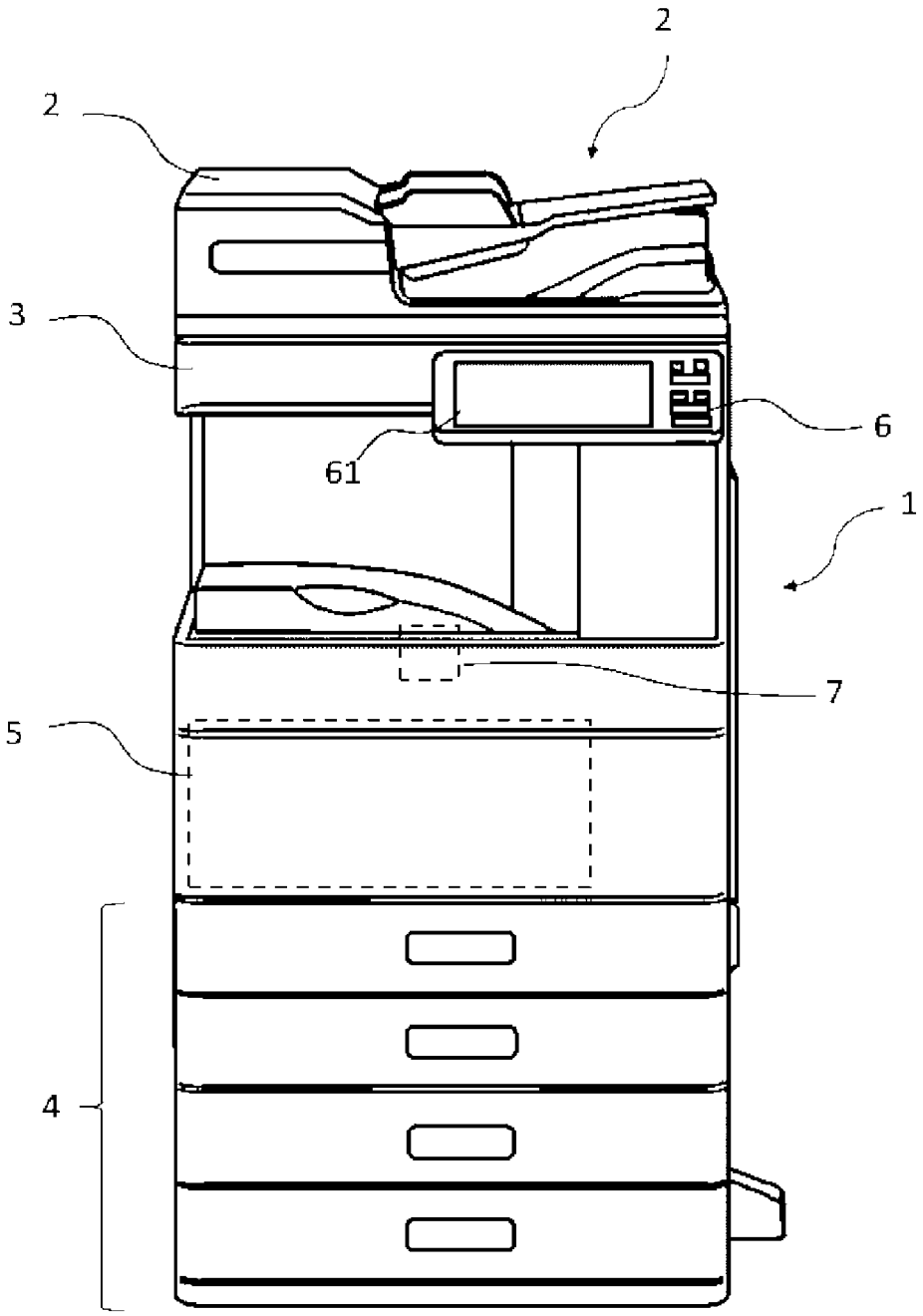
FIG. 1 is a cross-sectional view illustrating an image forming apparatus according to a first embodiment when seen from the front.

FIG. 1 is a cross-sectional view illustrating the image forming apparatus 1 according to the first embodiment when seen from the front.

The image forming apparatus 1 is, for example, a multifunctional peripheral (MFP) and includes an automatic document feeder 2, a reading unit 3, a paper feed unit 4, an image forming unit 5, an operation input unit 6, and a main control unit 7.

The automatic document feeder 2 is provided above the reading unit 3 and allows a document to automatically pass through a region above the reading unit 3. The reading unit 3 reads a surface of the document and acquires image data. The paper feed unit 4 includes, for example, a paper feed cassette, and paper on which an image is formed is stacked. The image forming unit 5 forms an image on paper fed from the paper feed unit 4 based on the image data acquired from the reading unit 3. The operation input unit 6 receives an operation input from a user based on a display content displayed on an operation screen 61.

The main control unit 7 will be described below.

Next, the automatic document feeder 2 according to the present embodiment will be described with reference to FIGS. 2 and 3.

Figure 2:
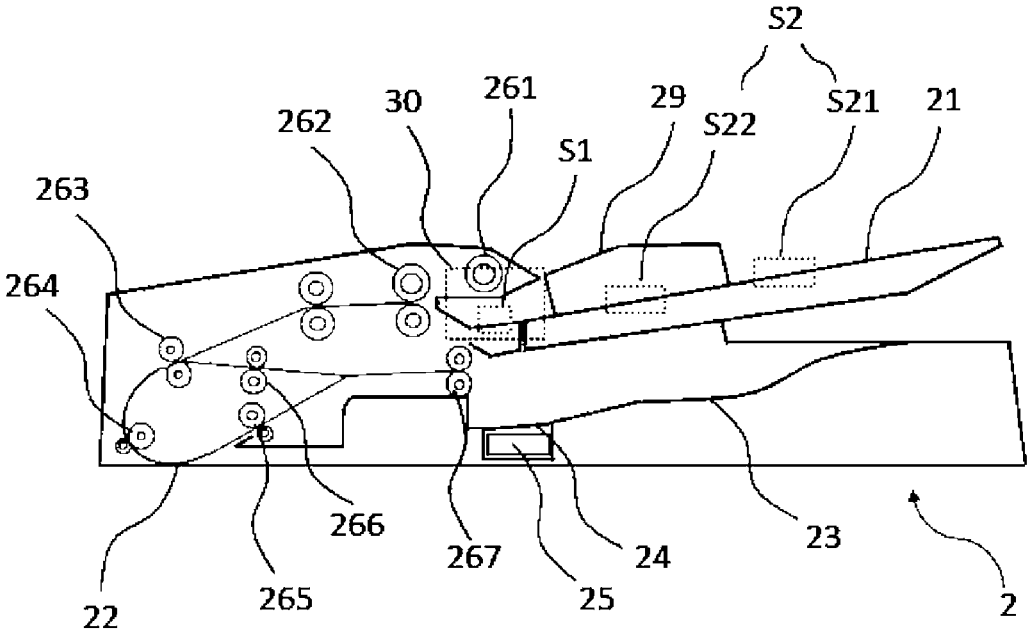
FIG. 2 is a cross-sectional view illustrating an automatic document feeder according to the first embodiment when seen from the front.

FIG. 2 is a cross-sectional view illustrating the automatic document feeder 2 according to the first embodiment when seen from the front.

Figure 3:
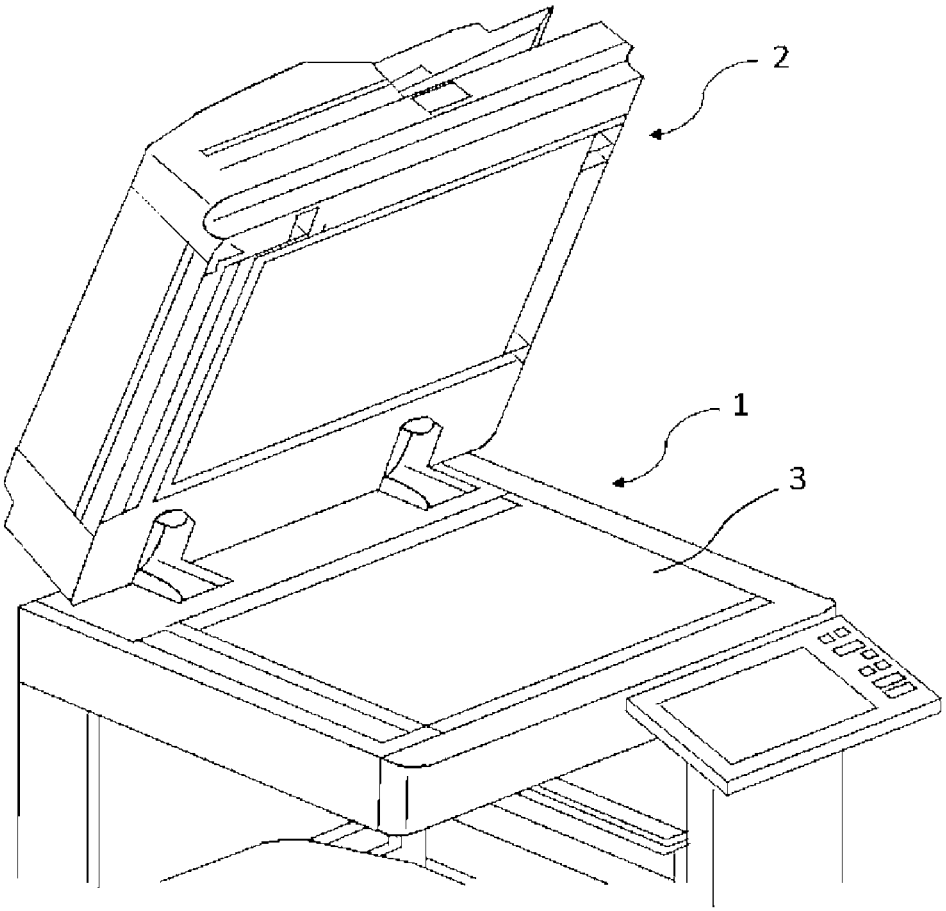
FIG. 3 is a perspective view illustrating the image forming apparatus according to the first embodiment when a document cover on which the automatic document feeder is mounted is opened.

FIG. 3 is a perspective view illustrating the image forming apparatus 1 according to the first embodiment when a document cover on which the automatic document feeder 2 is mounted is opened.

The automatic document feeder 2 according to the first embodiment is a reversing auto document feeder (RADF) and includes a document tray 21, a reading slit 22, a first tray 23, a second tray 25, a paper discharge guide 24, a conveying unit 26, and a control unit 28.

The automatic document feeder 2 is provided above the reading unit 3 of the image forming apparatus 1, in which a document is fed from the document tray 21, is conveyed by the conveying unit 26 described below, and is discharged to the first tray 23. As illustrated in FIG. 3, the automatic document feeder 2 is provided to be rotatable in a region above the image forming apparatus 1 and also functions as a document cover that holds a document when the document is set and read by the reading unit 3.

Referring back to FIG. 2, sensors provided in the automatic document feeder 2 will be described. The document tray 21 is a tray on which a document to be conveyed is stacked, and includes a document detection sensor S1 and a document size sensor S2. The document detection sensor S1 is, for example, an actuator, and when the actuator is pressed, a document is determined to be set.

The document size sensor S2 includes a document length sensor S21 and a document width sensor S22. The document length sensor S21 is configured with, for example, a plurality of actuators and detects the length of the document based on whether or not each of the actuators is pressed. The document width sensor S22 transmits a signal to the control unit 28 to detect the width of the document, for example, when a document width guide 29 provided in the document tray 21 is moved. The document size sensor S2 detects the size of the document based on a combination of detection results of the document length sensor S21 and the document width sensor S22.

The reading slit 22 is a hole that is provided halfway a conveyance path of the document of the automatic document feeder 2 and extends in a direction perpendicular to a conveying direction of the document. The reading slit 22 is provided on a bottom surface of the automatic document feeder 2. The document is read while being conveyed in contact with the reading unit 3 provided below the automatic document feeder 2 with the reading slit 22 interposed therebetween.

The first tray 23 is a paper discharge tray and is provided below the document tray 21. The first tray 23 is a tray on which the document that is conveyed from the document tray 21 by the conveying unit 26 and is discharged from a paper discharge roller 267 is stacked.

The paper discharge guide 24 is a member that is integrally provided with a stacking surface of the first tray 23 and is provided above the second tray 25. The paper discharge guide 24 includes a rotation mechanism 27 that is rotatable in a direction away from the second tray 25.

The second tray 25 according to the present embodiment is a tray on which a document M having a business card size is stacked and that is provided in a groove integrated with the first tray 23 and can be drawn out to a front side of the image forming apparatus 1 in a direction perpendicular to a document discharge direction.

Here, it is assumed that the second tray 25 described in the embodiment of the present specification is a tray for a document having a business card size. However, the second tray 25 is not limited to the tray for a document having a business card size and is also applicable to, for example, a document having a card size or a postcard size. In addition, the second tray 25 is not limited to a tray in the automatic document feeder 2 and is also applicable to a paper discharge tray in the image forming apparatus 1 or a paper post-processing apparatus.

The conveying unit 26 is a unit that conveys a document to the first tray 23 using a plurality of rollers, and includes a pickup roller 261, a paper feed roller 262, an intermediate conveying roller 263, a pre-reading roller 264, a post-reading roller 265, a reversing roller 266, and the paper discharge roller 267.

Regarding the conveyance path, as illustrated in FIG. 2, the pickup roller 261 provided above a document feeding port 30 lowers so as to approach the document tray 21 and conveys a document stacked on the document tray 21 to the paper feed roller 262. The document is conveyed to the pre-reading roller 264 through the intermediate conveying roller 263 by the paper feed roller 262. The document conveyed from the pre-reading roller 264 is conveyed in contact with the reading unit 3 exposed from the reading slit 22 through a first conveyance guide (not illustrated) and is further conveyed to the post-reading roller 265 through a second conveyance guide (not illustrated).

At this time, when only a single surface of the document is read, the document is conveyed from the post-reading roller 265 to the paper discharge roller 267 and is discharged to the first tray 23.

On the other hand, when both surfaces of the document are read, the paper discharge roller 267 that receives the document from the post-reading roller 265 is reversed, and the document is conveyed to the reversing roller 266. The reversing roller 266 conveys the document to the intermediate conveying roller 263, the document passes through the pre-reading roller 264 and the post-reading roller 265, and the document is discharged from the paper discharge roller 267 to the first tray 23.

The automatic document feeder 2 is not limited to the RADF and may be an auto document feeder (ADF) that discharges the document after reading only a single surface of the document by conveying the document once or a dual scan document feeder (DSDF) that can read both surfaces of the document at the same time.

Next, hardware configurations of the image forming apparatus 1 and the automatic document feeder 2 will be described with reference to FIG. 4.

Figure 4:
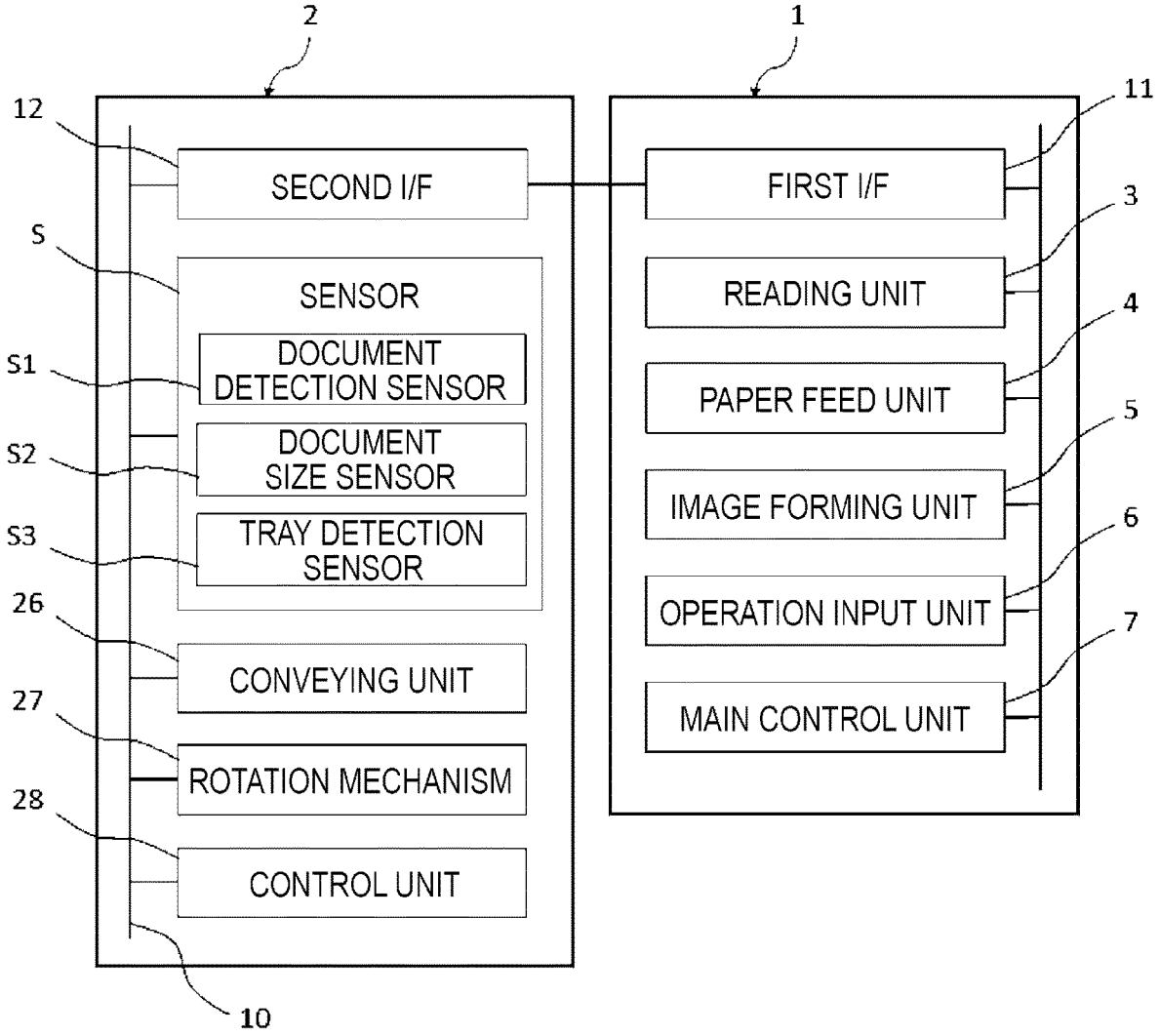
FIG. 4 is a control block diagram illustrating the image forming apparatus and the automatic document feeder according to the first embodiment.

FIG. 4 is a control block diagram illustrating the image forming apparatus 1 and the automatic document feeder 2 according to the first embodiment.

The image forming apparatus 1 includes the main control unit 7 that performs an overall operation control of the image forming apparatus 1. In addition, the automatic document feeder 2 includes the control unit 28 that exchanges signals with the main control unit 7 and performs an operation control of the automatic document feeder 2.

The main control unit 7 is configured with a read only memory (ROM) that stores a control program of the image forming apparatus 1, a random access memory (RAM) that temporarily stores a process for executing the control program, and a central processing unit that is hardware executing a command set of the control program.

The control unit 28 is configured with a ROM that stores a control program of the automatic document feeder 2, a RAM that temporarily stores a process for executing the control program, and a CPU that is hardware executing a command set of the control program.

A first I/F 11 and a second I/F 12 are hardware interfaces. Data communication between the image forming apparatus 1 and the automatic document feeder 2 is executed through, for example, serial communication of transmit exchange data (TxD) and received exchange data (Rxd). Further, the image forming apparatus 1 and the automatic document feeder 2 exchange signals through a communication request signal (REQ) and a communication request response signal (ACK).

The sensor S is a generic term for the document detection sensor S1, the document size sensor S2, and a tray detection sensor S3. The tray detection sensor S3 is a sensor that detects the second tray 25 and will be described in detail with reference to FIG. 5A.

The main control unit 7 included in the image forming apparatus 1 is connected to the reading unit 3, the paper feed unit 4, the image forming unit 5, and the operation input unit 6 via a bus 10. In addition, the image forming apparatus 1 is connected to the first I/F 11 (interface) and the second I/F 12 of the automatic document feeder 2 via the bus 10, and is connected to the sensor S, the conveying unit 26, the rotation mechanism 27, and the control unit 28.

Next, the second tray 25 will be described with reference to FIG. 5A.

Figure 5A:
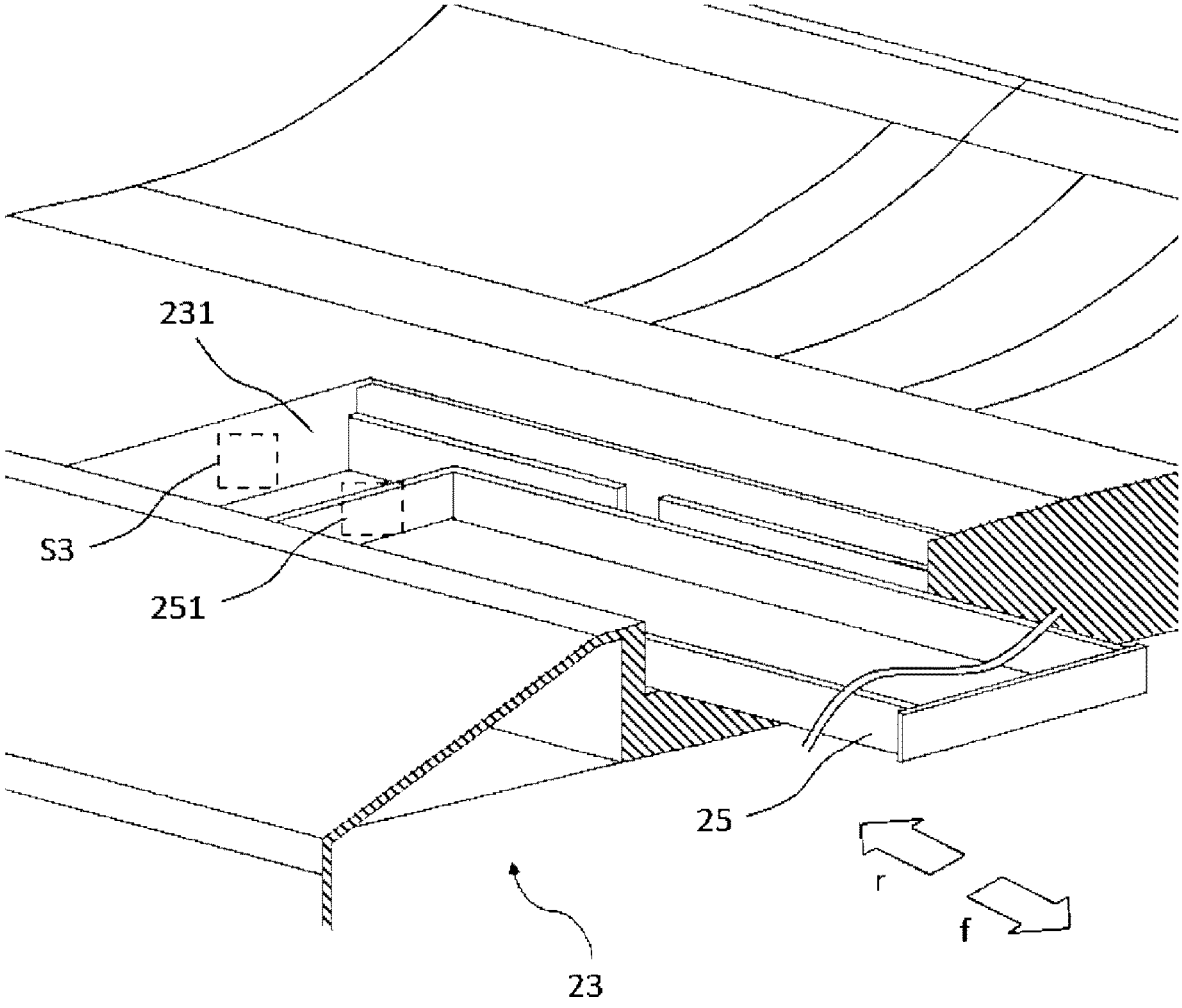
FIG. 5A is a perspective view illustrating a second tray according to the first embodiment.

FIG. 5A is a perspective view illustrating the second tray 25 according to the first embodiment. Since FIG. 5A illustrates a structure of the second tray 25, the paper discharge guide 24, a rotation shaft 273, and a solenoid 272 are not illustrated.

Here, a rf direction illustrated in FIG. 5A is a direction perpendicular to a horizontal direction and a document discharge direction.

The second tray 25 according to the embodiment is a box-shaped member obtained by removing a top surface from a rectangular parallelepiped, and is a tray on which the discharged document M having a business card size is stacked. As illustrated in FIG. 5A, the second tray 25 is provided so as to be stored in a tray groove 231 of the first tray 23 and can be drawn out in the rf direction.

In addition, the length of the document M on the stacking surface of the second tray 25 in the document discharge direction is obtained, for example, by adding 10 mm to the length of a business card size in the discharge direction, and does not have a space in which stacked paper is dispersed. This length in the discharge direction is determined in advance, for example, depending on a paper discharge speed of amounted unit and a position of the paper discharge roller 267.

The tray groove 231 is a groove that is provided in the first tray 23 and stores the second tray 25 and includes the tray detection sensor S3. The tray detection sensor S3 is, for example, a reed switch, is provided in a rear end portion of the tray groove 231 in the r direction, and operates when a magnet 251 comes into contact therewith. The magnet 251 is provided on a surface of the second tray 25 in the r direction so as to face the tray detection sensor S3. When the tray detection sensor S3 and the magnet 251 are in contact with each other, the control unit 28 determines that the second tray 25 is incorporated into the tray groove 231 of the first tray 23.

The tray detection sensor S3 is not limited to the reed switch using the magnet 251 and may be any sensor as long as the tray detection sensor S3 detects the presence of the second tray 25 when the second tray 25 is set. For example, the tray detection sensor S3 may be a physical switch or an optical sensor.

The paper discharge guide 24 and the rotation mechanism 27 will be described with reference to FIG. 5B.

Figure 5B:
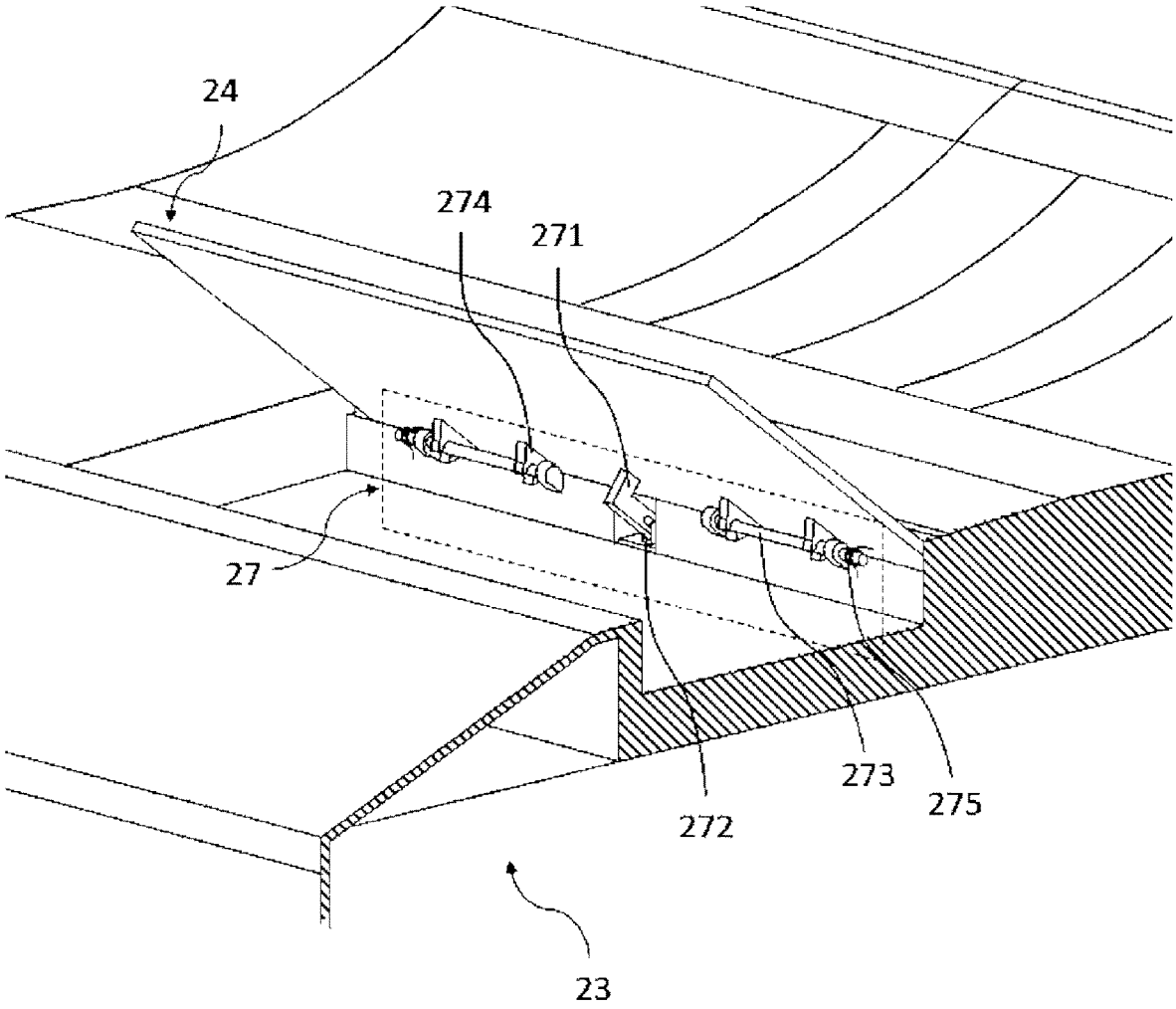
FIG. 5B is a perspective view illustrating a paper discharge guide according to the first embodiment.

FIG. 5B is a perspective view illustrating the paper discharge guide 24 according to the first embodiment. Since FIG. 5B illustrates the paper discharge guide 24, the second tray 25 is not illustrated.

The paper discharge guide 24 is a rectangular plate-shaped member that guides the discharged document M to the second tray 25 and is rotatable by the rotation mechanism 27.

The rotation mechanism 27 includes a connection portion 271, the solenoid 272, the rotation shaft 273, a rotation bearing 274, and an alpha spring 275.

The connection portion 271 is a L-shaped member that includes one end connected to a bottom surface portion of the paper discharge guide 24 and the other end connected to the solenoid 272 and protrudes from an outer circumference of the second tray 25 to the other end side. The connection portion 271 is positioned at the center of the paper discharge guide 24 in the rf direction illustrated in FIG. 5A and is provided on a downstream side in the document discharge direction.

The solenoid 272 is provided such that a plunger faces upward, and when the solenoid 272 is driven, the plunger moves downward to be stored in a frame. The solenoid 272 is provided to be connected to the other end side of the connection portion 271.

The rotation shaft 273 is a rod-shaped member extending in the rf direction and is supported by a member that protrudes to a side surface on the downstream side of the tray groove 231 in the document discharge direction.

The rotation bearing 274 is provided in the paper discharge guide 24 and meshes with the rotation shaft 273.

When the solenoid 272 is driven such that a force in the downward direction is applied to the other end of the connection portion 271, the paper discharge guide 24 rotates around the rotation shaft 273.

In a closed state, the paper discharge guide 24 is a part of the first tray 23 and functions as the stacking surface of the discharged document.

The alpha spring 275 is an α-shaped spring provided in the rotation bearing 274 and applies a force to a direction in which the paper discharge guide 24 rotates to be closed, the direction being opposite to a direction in which the paper discharge guide 24 functioning as a lid of the tray groove 231 rotates to be opened.

Means for operating the paper discharge guide 24 is not limited to the solenoid 272 and may be an opening and closing method using a well-known technique, for example, an electrical method such as motor driving or an electromagnetic clutch or a manual method in which a user directly opens and closes the paper discharge guide 24 using a dial or a lever. In addition, the paper discharge guide 24 may be a member that is manually attachable and detachable instead of the member that is rotatable to be opened and closed.

Next, regarding the rotation mechanism 27 of the paper discharge guide 24, a method of stacking the document M on the second tray 25 will be described in detail with reference to FIGS. 6A to 6C.

Figure 6A:
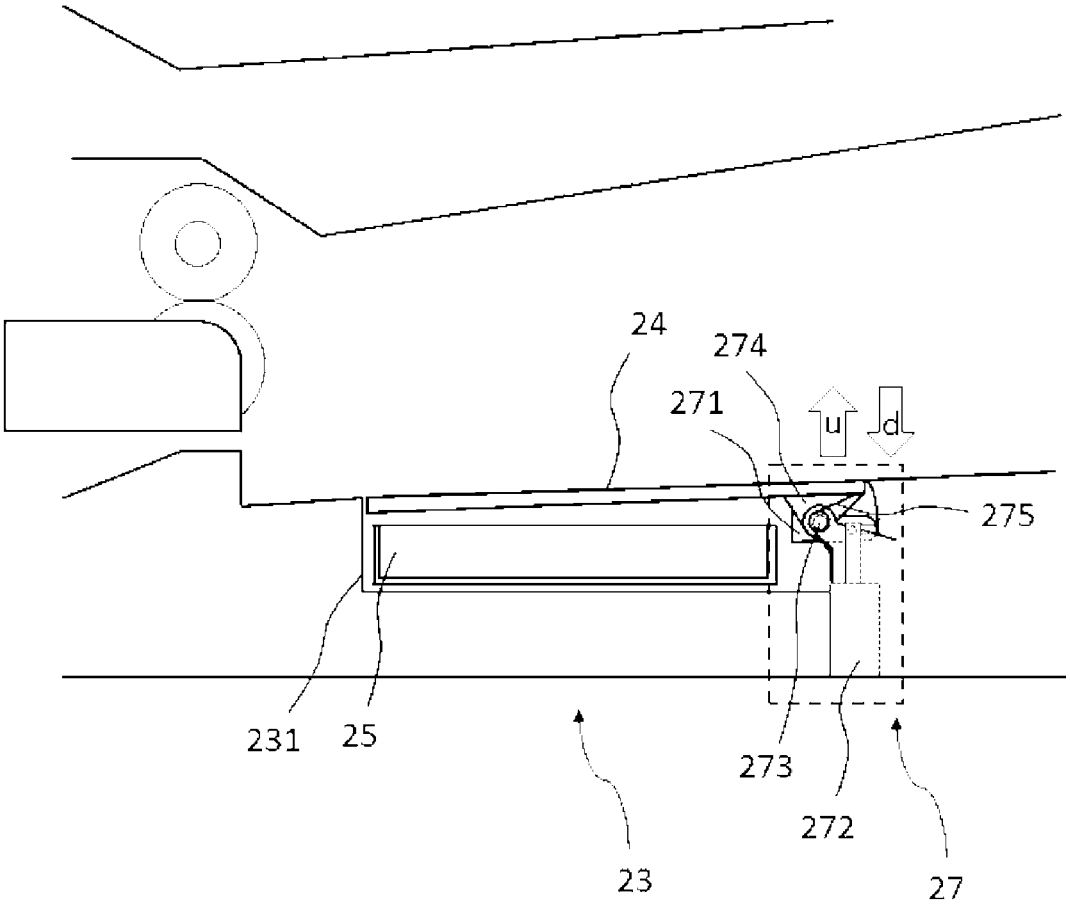
FIG. 6A is a cross-sectional view illustrating the automatic document feeder according to the first embodiment.

FIG. 6A is a cross-sectional view illustrating the automatic document feeder 2 according to the first embodiment. An arrow d illustrated in FIG. 6A represents a downward direction with respect to a horizontal surface, and an arrow u illustrated in FIG. 6A represents an upward direction with respect to the horizontal surface.

As described above using FIG. 5B, the rotation mechanism 27 includes the connection portion 271, the solenoid 272, the rotation shaft 273, the rotation bearing 274, and the alpha spring 275. Originally, in the cross-sectional view of FIG. 6A, the solenoid 272 cannot be observed but is indicated by a broken line to show an overall position relationship in the rotation mechanism 27.

The paper discharge guide 24 is integrally provided with the stacking surface of the first tray 23 so as to cover the tray groove 231. In the embodiment, unless the document M having a business card size is discharged, a force in the u direction is applied to one end of the paper discharge guide 24 where the alpha spring 275 is provided by the alpha spring 275 provided in the rotation shaft 273 such that the paper discharge guide 24 is closed.

Figure 6B:
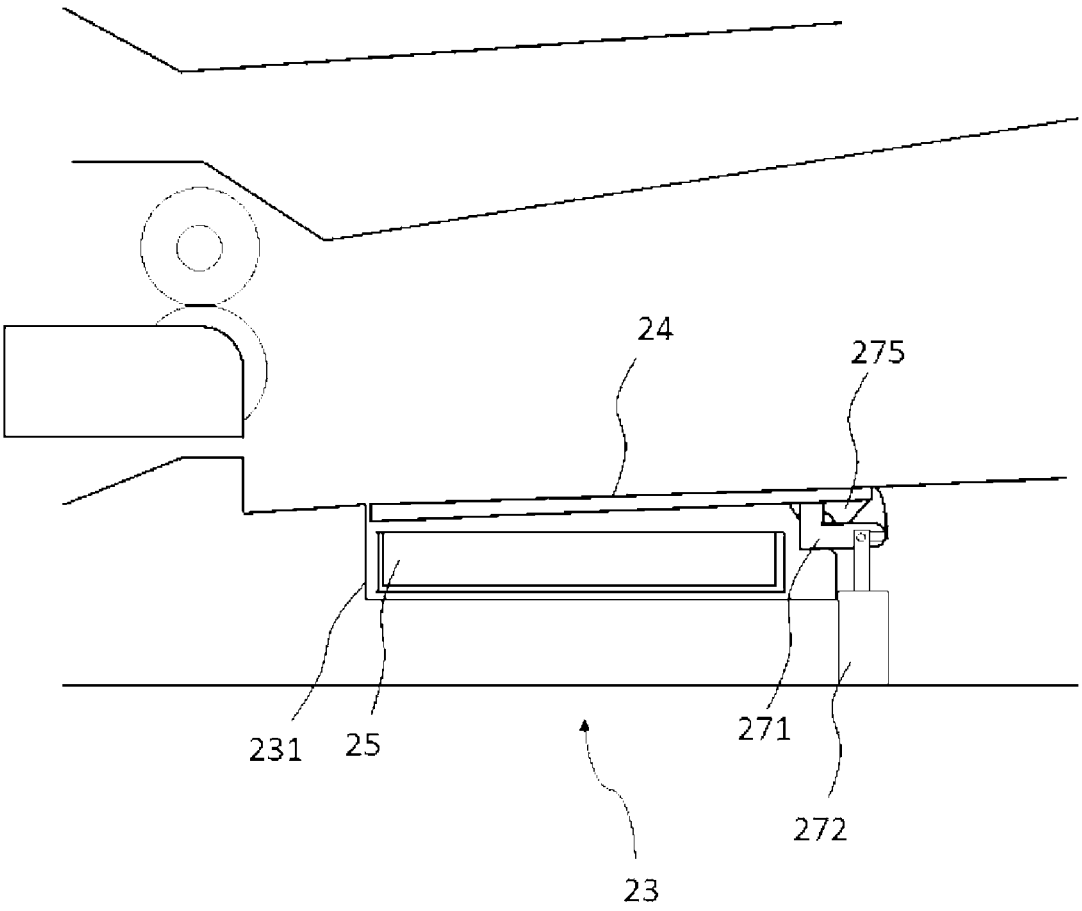
FIG. 6B is a cross-sectional view illustrating an operation of a rotation mechanism in the paper discharge guide according to the first embodiment.
Figure 6C:
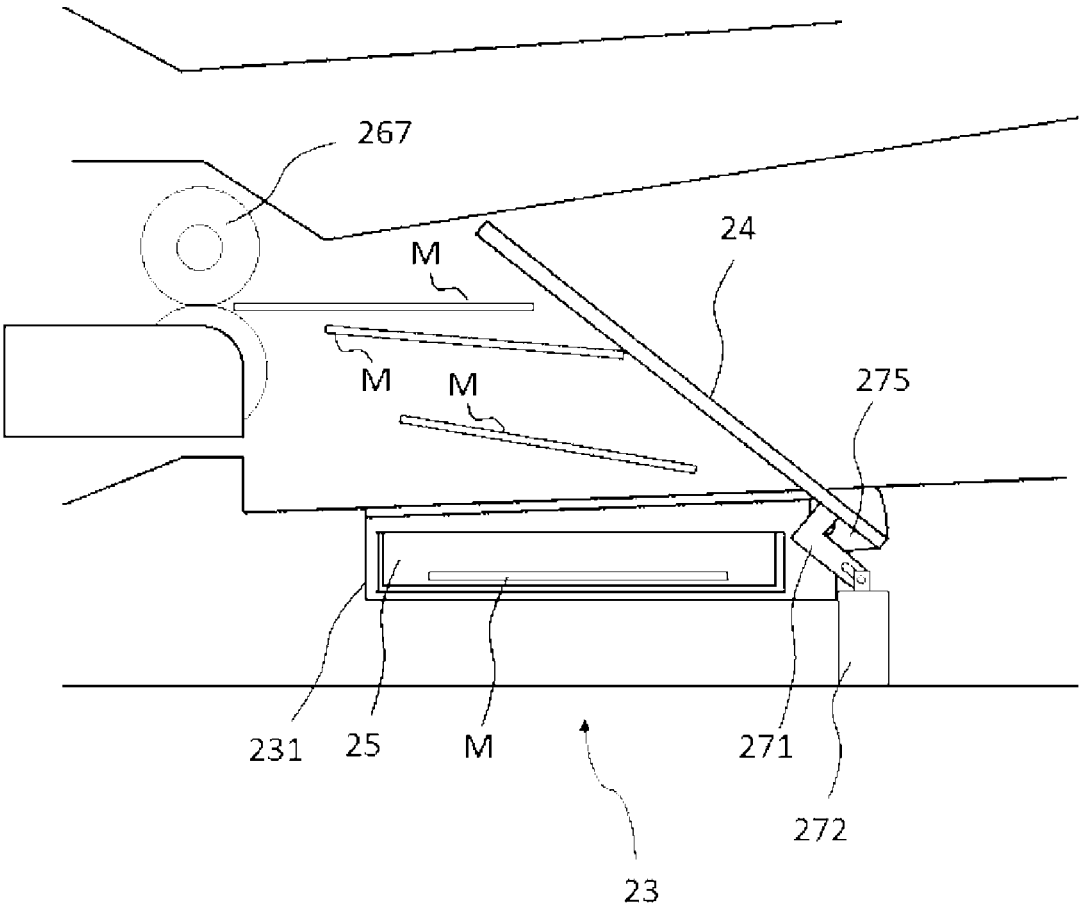
FIG. 6C is a cross-sectional view illustrating the operation of the rotation mechanism in the paper discharge guide according to the first embodiment.

FIGS. 6B and 6C are cross-sectional views illustrating an operation of the rotation mechanism 27 in the paper discharge guide 24 according to the first embodiment. More specifically, FIG. 6B illustrates a state before the operation, and FIG. 6C illustrates a state after the operation. In addition, a plurality of documents M illustrated in FIG. 6C represent an image of a trajectory of the document M to be stacked on the second tray 25.

As illustrated in FIG. 6B, in the rotation mechanism 27, the plunger of the solenoid 272 is connected to the connection portion 271, and when the solenoid 272 is driven, the paper discharge tray rotates around the rotation shaft 273 illustrated in FIG. 6A in conjunction with the paper discharge tray as illustrated in FIG. 6C.

The document M discharged from the paper discharge roller 267 is guided to and stacked on the second tray 25 provided in a lower region by coming into contact with the bottom surface of the paper discharge guide 24 that is rotated to be opened as illustrated in FIG. 6C.

When the paper discharge guide 24 is closed, the solenoid 272 is turned off, a force in the d direction is applied to one end of the paper discharge guide 24 by the alpha spring 275, and the paper discharge guide 24 returns to the original position.

Next, a control of the automatic document feeder 2 during execution of a job will be described with reference to FIG. 7.

Figure 7:
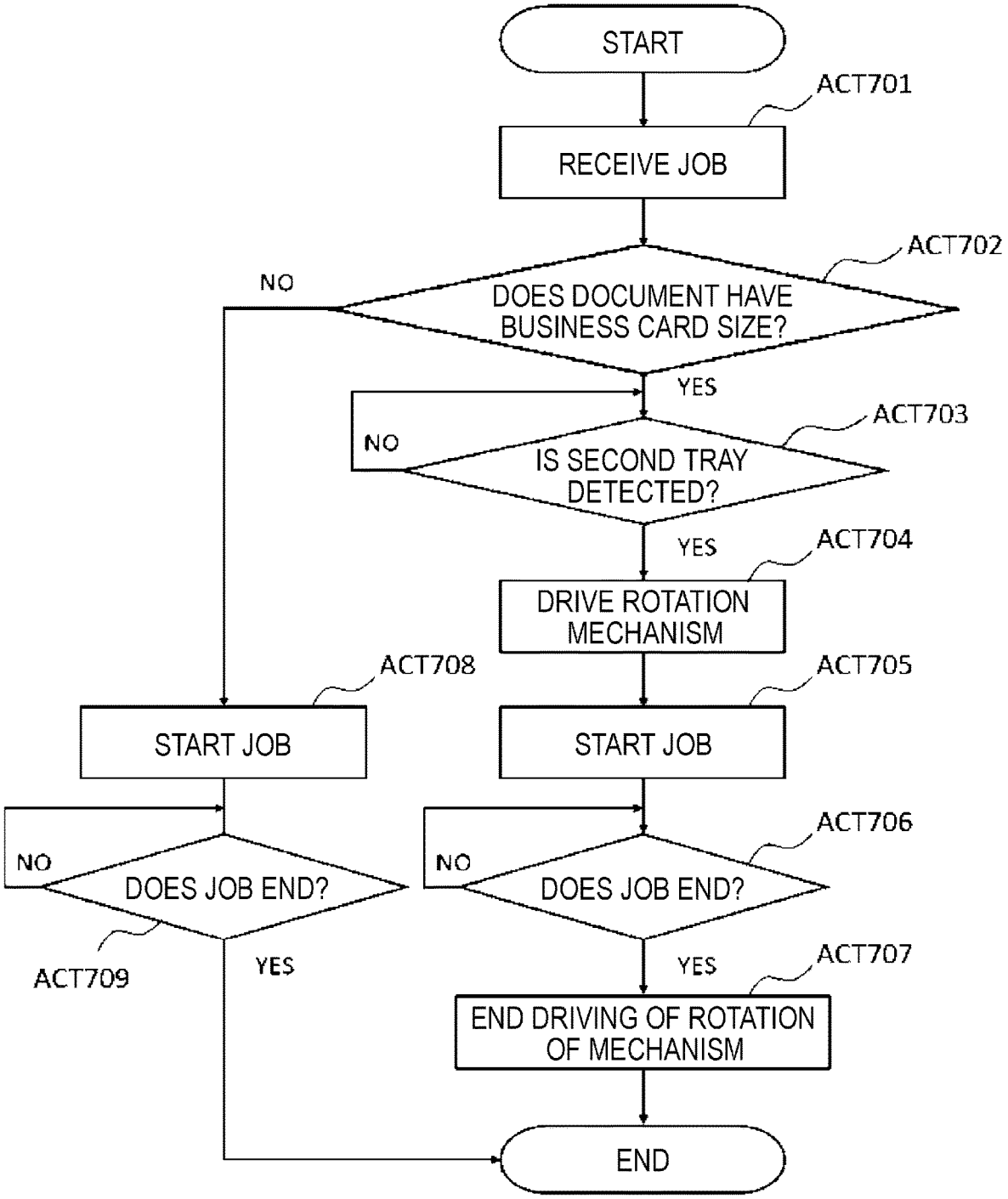
FIG. 7 is a control flowchart illustrating a reading process in the first embodiment.

FIG. 7 is a control flowchart illustrating a reading process in the first embodiment.

Here, the job refers to a series of processes of reading a document set on the document tray 21 using the reading unit 3 and subsequently conveying the document to the first tray 23 or the second tray 25.

First, the main control unit 7 receives a job through a personal computer (PC; not illustrated) or the operation input unit 6 (ACT 701). When the size of the document detected by the document size sensor S2 is not the business card size (ACT 702, NO), the control unit 28 executes the job (ACT 708). Next, when the job does not end (ACT 709, NO), the control unit 28 continues the control. When the job ends (ACT 709, YES), the control unit 28 ends the control. That is, the document is conveyed to the first tray 23 by the rotation mechanism 27 without opening the paper discharge tray.

On the other hand, when the size of the document detected by the document size sensor S2 is the business card size (ACT 702, YES), the tray detection sensor S3 detects whether or not the second tray 25 is set in the tray groove 231 (ACT 703). When the second tray 25 is not set in the tray groove 231 (ACT 703, NO), the control unit 28 continues the control until the tray detection sensor S3 detects the second tray 25. When the tray detection sensor S3 detects the second tray 25 (ACT 703, YES), the control unit 28 drives the rotation mechanism 27 (ACT 704) and executes the job (ACT 705). That is, the paper discharge guide 24 is opened by the rotation mechanism 27, and the document M is conveyed to the second tray 25.

Next, when the job does not end (ACT 706, NO), the control unit 28 continues the control. When the job ends (ACT 706, YES), the control unit 28 ends the driving of the rotation mechanism 27 and ends the control. At this time, after the end of the rotation mechanism 27, the paper discharge guide 24 returns to the original position due to the alpha spring 275 as described above in FIG. 6A.

In the above-described flowchart, when the job is received (ACT 701), the size of the document is determined by the document size sensor S2, but the embodiment is not limited thereto. For example, the control unit 28 may cause an operation screen 61 to display a screen for allowing a user to set the document size. When the business card size is selected by the user, the control unit 28 determines that the document has the business card size and proceeds to ACT 703.

In the first embodiment, the second tray 25 is provided to be stored in the tray groove 231 provided in the first tray 23, and the document M is guided by the paper discharge guide 24 and is stacked on the second tray 25. The second tray 25 can be drawn out from the tray groove 231, and does not have a space in which the discharged documents M are dispersed in the discharge direction. Therefore, the documents M that are aligned to some extent can be picked up at once.

In addition, even when the automatic document feeder 2 according to the embodiment does not include the second tray 25, the document M stacked on the tray groove 231 has a certain level of aligning properties without being dispersed in the discharge direction. Therefore, the user does not have to align the dispersed documents M. Further, a part of the paper discharge tray is deepened by the tray groove 231. Therefore, the user can scrape out the document M to collect the document M by putting a hand into the tray groove 231 that is a space provided in the document tray 21.

Second Embodiment

The automatic document feeder 2 according to a second embodiment is different from that according to the first embodiment, in that the automatic document feeder 2 includes an opening and closing detection sensor S4 for detecting the opening and closing of the paper discharge guide 24 and a detection claw 241. Regarding the respective components of the second embodiment in FIG. 8, the same components as those in the control block diagram of the first embodiment in FIG. 4 will be represented by the same reference numerals. In addition, regarding the respective components of the second embodiment in FIGS. 9A and 9B, the same components as those in the cross-sectional view illustrating the operation of the rotation mechanism 27 of the second tray 25 according to the first embodiment in FIGS. 6B and 6C will be represented by the same reference numerals. Further, regarding the respective components of the second embodiment in FIG. 12, the same components as those in the control flowchart of the first embodiment in FIG. 7 will be represented by the same reference numerals.

Figure 8:
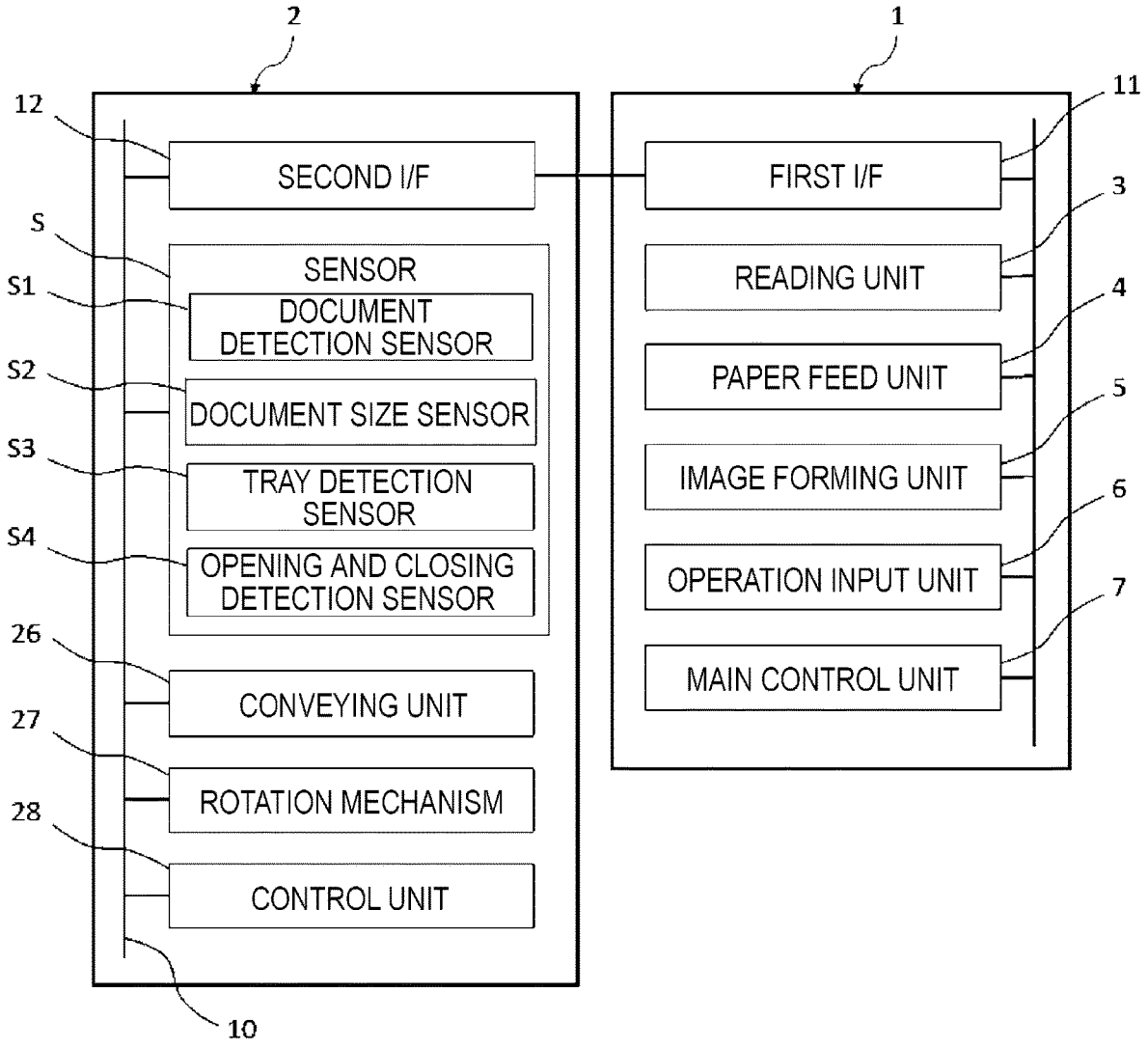
FIG. 8 is a control block diagram illustrating the image forming apparatus and the automatic document feeder according to a second embodiment.

Hardware configurations of the image forming apparatus 1 and the automatic document feeder 2 according to the second embodiment will be described with reference to FIG. 8. FIG. 8 is a control block diagram illustrating the image forming apparatus 1 and the automatic document feeder 2 according to the second embodiment.

The second embodiment is different from the first embodiment, in that the opening and closing detection sensor S4 is added to the configuration illustrated in FIG. 4. In addition, the sensor S is a generic term for not only the document detection sensor S1, the document size sensor S2, and the tray detection sensor S3 in the first embodiment but also the opening and closing detection sensor S4 in the second embodiment.

The opening and closing detection sensor S4 is connected to the conveying unit 26, the rotation mechanism 27, the control unit 28, and the second I/F 12 via the bus 10. In addition, the opening and closing detection sensor S4 is connected to the first I/F 11 of the image forming apparatus 1 via the bus 10 and the second I/F 12, and is connected to the reading unit 3, the paper feed unit 4, the image forming unit 5, the operation input unit 6, and the main control unit 7.

Since the units other than the sensor S and the opening and closing detection sensor S4 are as described above in the first embodiment, the description thereof will not be repeated.

Next, the rotation mechanism 27 of the paper discharge guide 24 in the second embodiment will be described with reference to FIGS. 9A and 9B.

Figure 9A:
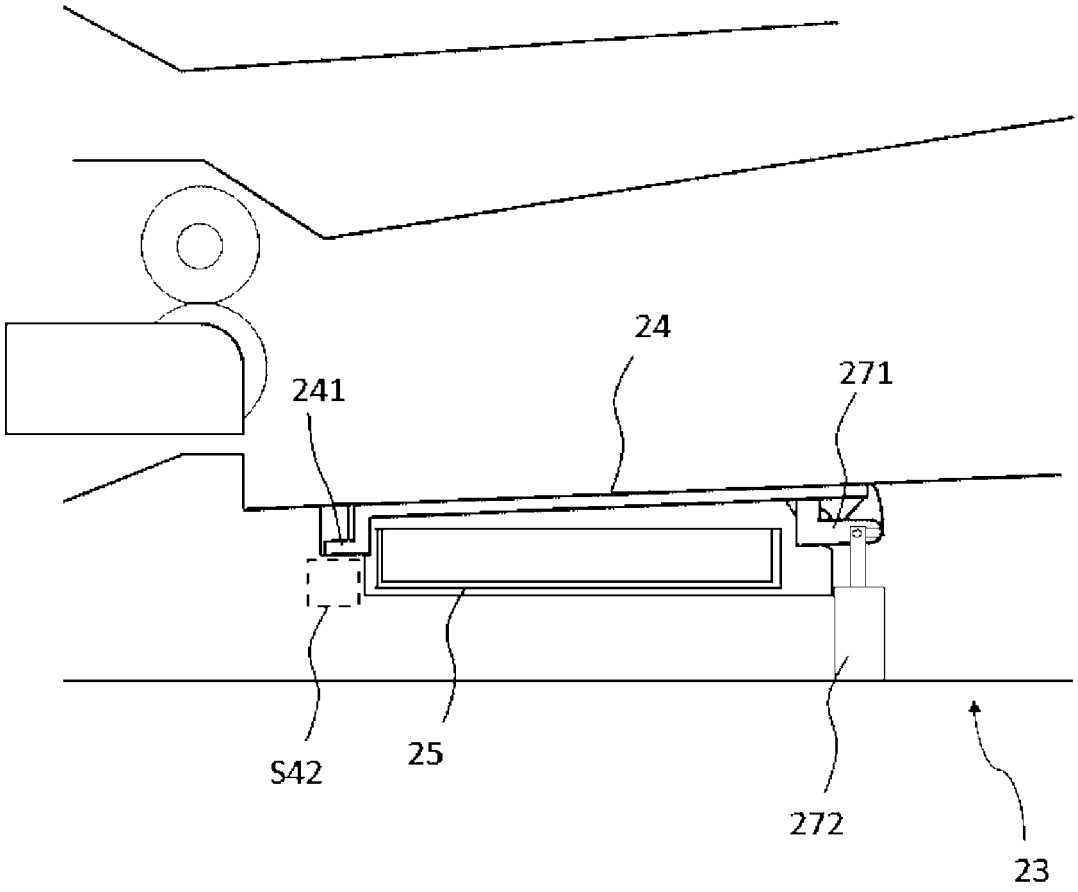
FIG. 9A is a cross-sectional view illustrating an operation of a rotation mechanism in the paper discharge guide according to the second embodiment.
Figure 9B:
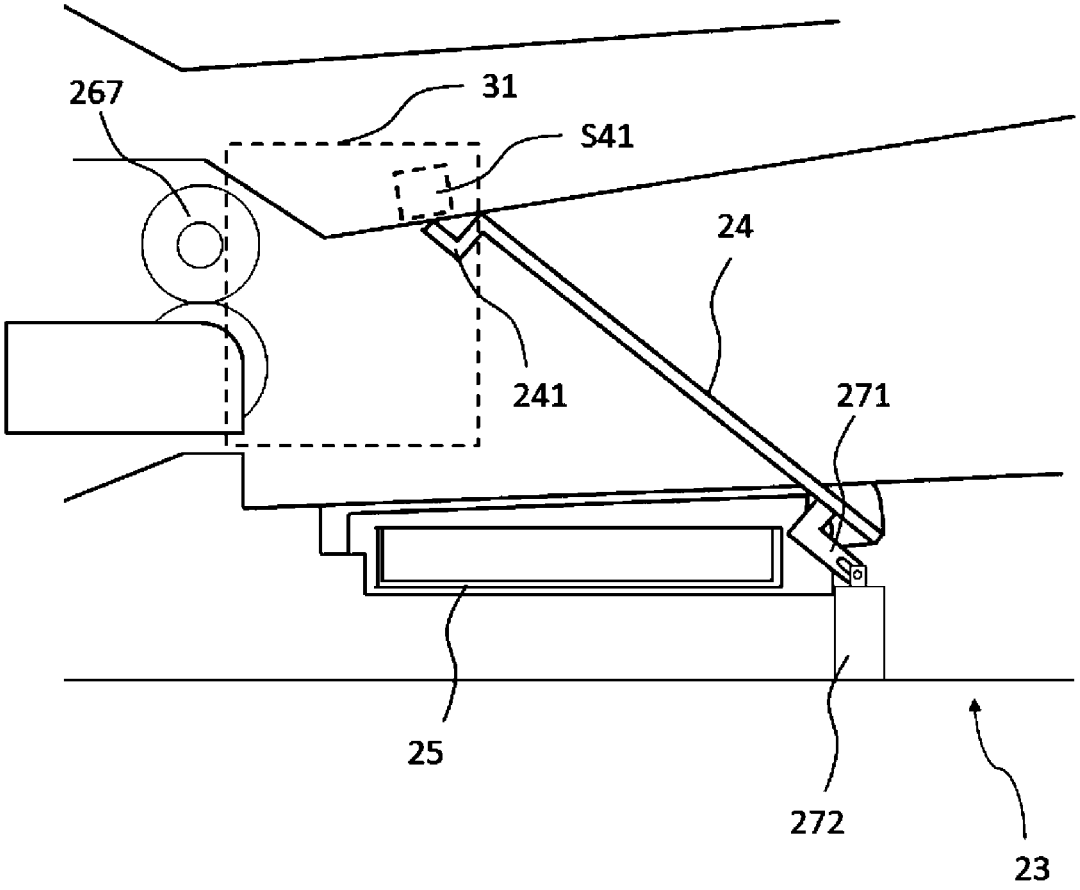
FIG. 9B is a cross-sectional view illustrating an operation of a rotation mechanism in the paper discharge guide.

FIGS. 9A and 9B are cross-sectional views illustrating an operation of the rotation mechanism 27 in the paper discharge guide 24 according to the second embodiment.

FIGS. 9A and 9B of the second embodiment are different from FIGS. 6B and 6C of the first embodiment, in that the opening and closing detection sensor S4 and the detection claw 241 are added to the configuration illustrated in FIGS. 6B and 6C.

The detection claw 241 is provided in a direction opposite to the side of the paper discharge guide 24 where the connection portion 271 is provided, that is, on an upstream side in the document discharge direction, and protrudes from an outer circumference of the paper discharge guide 24.

The opening and closing detection sensor S4 is configured with an opening sensor S41 and a closing sensor S42. As illustrated in FIG. 9A, the closing sensor S42 is provided upstream of the tray groove 231 in the document discharge direction. As illustrated in FIG. 9B, when the paper discharge guide 24 rotates in a direction in which the paper discharge guide 24 is opened, the opening sensor S41 is provided such that the detection claw 241 comes into contact with an upper portion of a document discharge port 31.

The opening and closing detection sensor S4 is, for example, an actuator, and while the actuator of the closing sensor S42 is pressed by the detection claw 241, the control unit 28 detects that the paper discharge guide 24 is closed. In addition, while the actuator of the opening sensor S41 is pressed by the detection claw 241, the control unit 28 detects that the paper discharge guide 24 is opened to the maximum degree in a range where the paper discharge guide 24 is rotatable.

When only the closing sensor S42 in the opening and closing detection sensor S4 is provided, the opening and closing of the paper discharge guide 24 can also be detected by detecting ON and OFF of the closing sensor S42. However, even when the paper discharge guide 24 is not completely opened, the control unit 28 determines that "the paper discharge guide 24 is opened". Conversely, in a case where only the opening sensor S41 is provided such that the opening and closing of the paper discharge guide 24 is detected by detecting ON and OFF of the opening sensor S41, even when the paper discharge guide is not completely closed, the control unit 28 determines that "the paper discharge guide 24 is closed". Therefore, in order to detect the opening and closing of the paper discharge guide 24, it is desirable to provide both the opening sensor S41 and the closing sensor S42.

Next, a control of the automatic document feeder 2 during execution of a job in the second embodiment will be described with reference to FIGS. 10 to 12.

Figure 10:
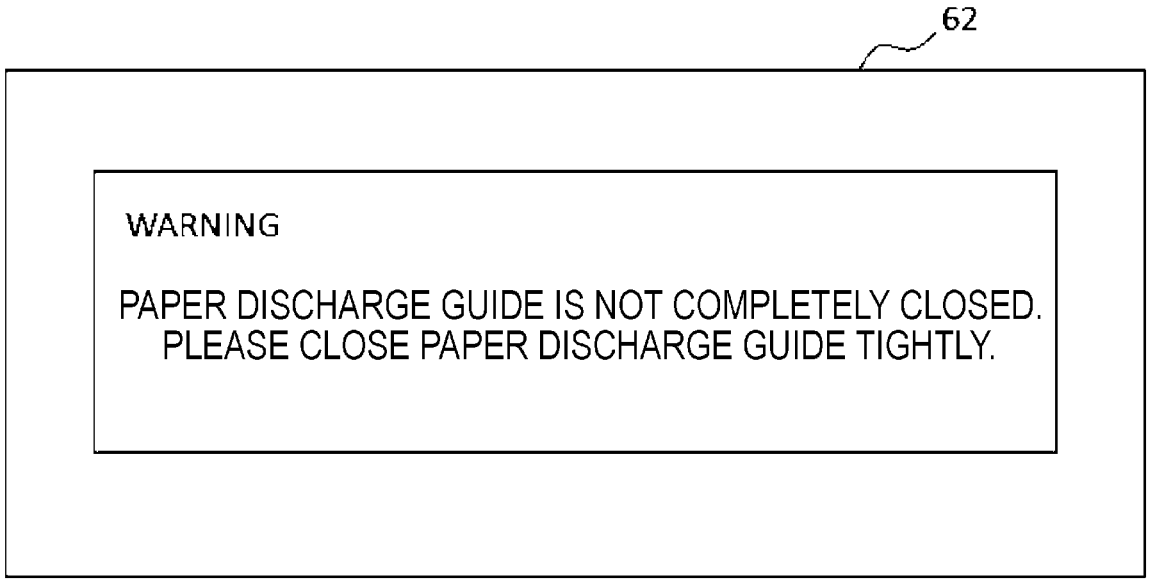
FIG. 10 is an example of a first error screen displayed when a closing sensor according to the second embodiment is not detected.

FIG. 10 is an example of a first error screen 62 displayed when the closing sensor S42 according to the second embodiment is not detected. The first error screen 62 is a screen for notifying the user that the paper discharge guide 24 is not closed.

Figure 11:
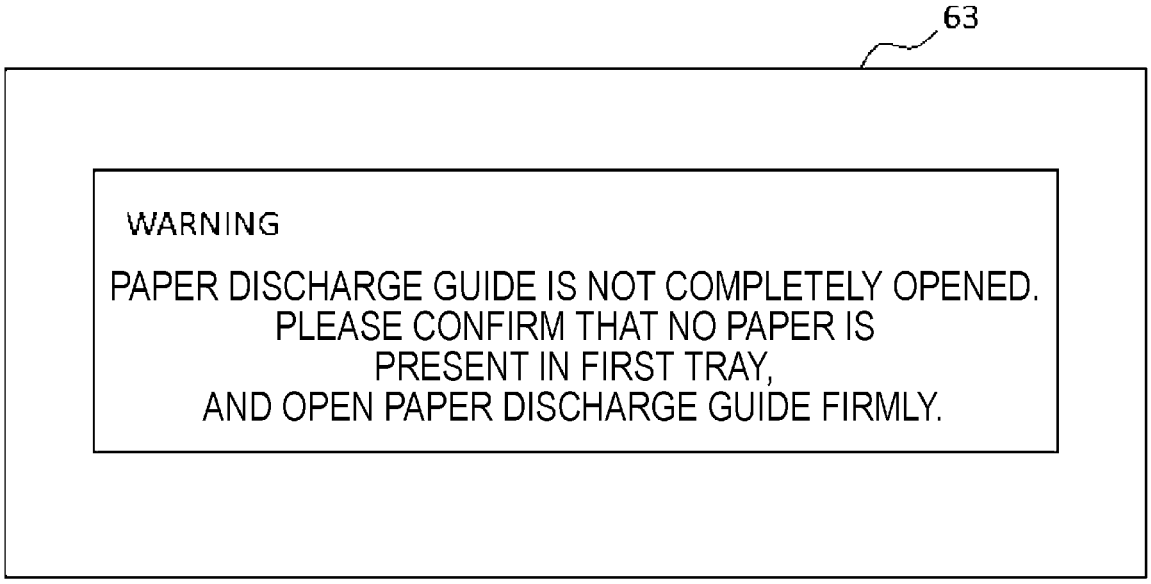
FIG. 11 is an example of a second error screen displayed when an opening sensor according to the second embodiment is not detected.

FIG. 11 is an example of a second error screen 63 displayed when the opening sensor S41 according to the second embodiment is not detected. The second error screen 63 is a screen for notifying the user that the paper discharge guide 24 is not opened.

Figure 12:
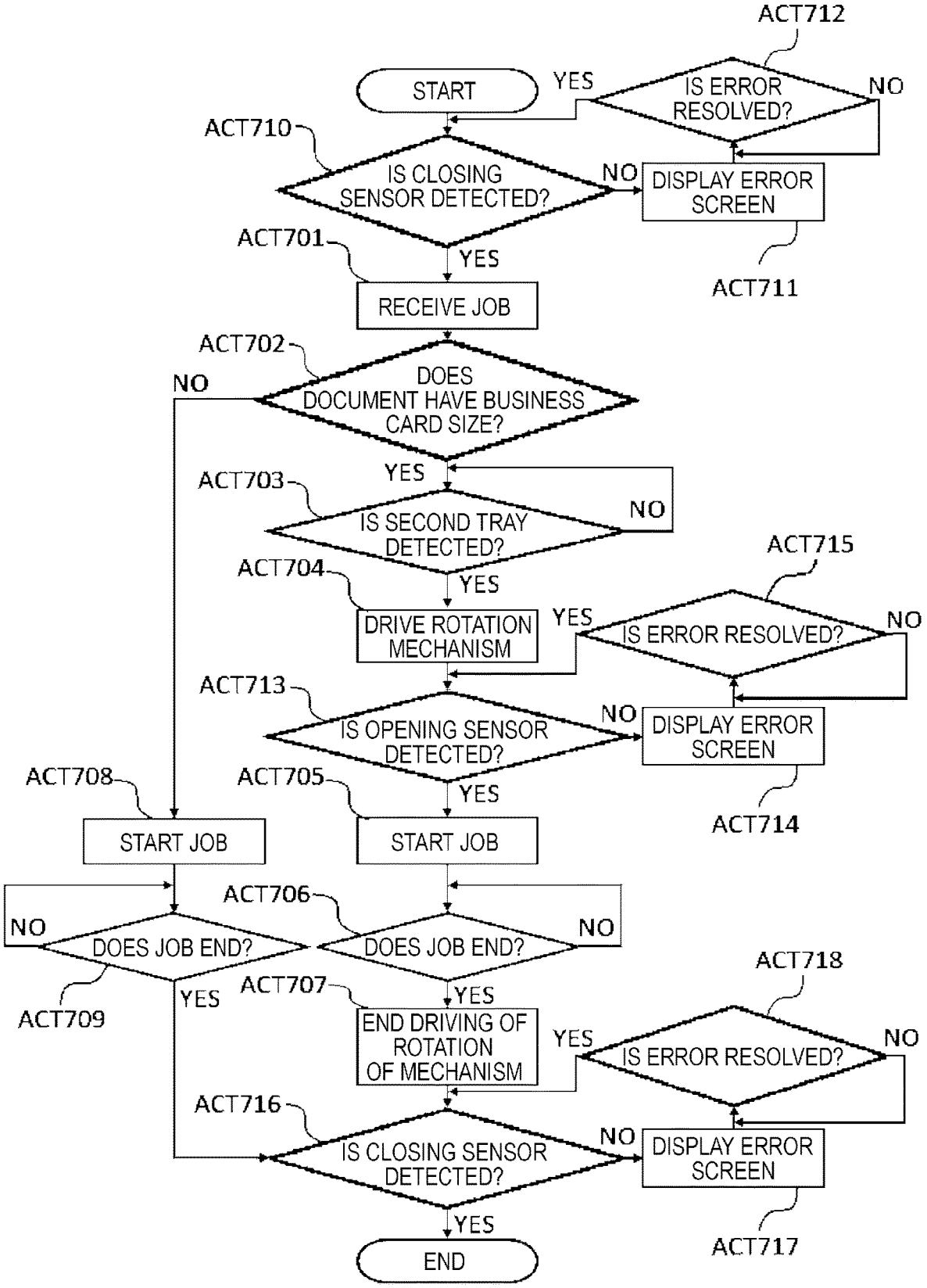
FIG. 12 is a control flowchart illustrating a reading process in the second embodiment.

FIG. 12 is a control flowchart illustrating a reading process in the second embodiment.

The reading process in the second embodiment illustrated in FIG. 12 is different from the reading process in the first embodiment illustrated in FIG. 7, in that the process of detecting the opening sensor S41 and the closing sensor S42 and the process of displaying the screen when an error is detected by the opening and closing detection sensor S4 are added to the configuration illustrated in FIG. 7.

First, the control unit 28 detects whether or not the closing sensor S42 is pressed (ACT 710). When the closing sensor S42 is not pressed (ACT 710, NO), the control unit 28 causes the operation screen 61 to display the first error screen 62 (refer to FIG. 10) showing that the paper discharge guide 24 is not completely closed (ACT 711). When the closing sensor S42 is pressed, the first error screen 62 is removed (ACT 712, YES). When the closing sensor S42 is not pressed (ACT 712, NO), the first error screen 62 is continuously displayed. When the closing sensor S42 is pressed (ACT 710, YES), as in the first embodiment, the main control unit 7 proceeds to the process of receiving a job through a PC (not illustrated) or the operation input unit 6 (ACT 701).

In ACT 701, as in the first embodiment, the main control unit 7 receives the job through a personal computer (PC; not illustrated) or the operation input unit 6. When the size of the document detected by the document size sensor S2 is not the business card size (ACT 702, NO), the control unit 28 executes the job (ACT 708). Next, when the job does not end (ACT 709, NO), the control unit 28 continues the control.

On the other hand, when the job ends in ACT 709 (ACT 709, YES), unlike the first embodiment, the control unit 28 detects whether or not the closing sensor S42 is pressed (ACT 716). When the closing sensor S42 is not pressed (ACT 716, NO), the control unit 28 causes the operation screen 61 to display the first error screen 62 (refer to FIG. 10) showing that the paper discharge guide 24 is not completely closed (ACT 717). When the closing sensor S42 is pressed, the first error screen 62 is removed (ACT 718, YES). When the closing sensor S42 is not pressed (ACT 718, NO), the first error screen 62 is continuously displayed. When the closing sensor S42 is pressed (ACT 716, YES), the control unit 28 ends the control.

Examples of the case where the closing sensor S42 is not pressed by the detection claw 241 in ACT 710 include a case where the closed state of the paper discharge guide 24 cannot be maintained because the alpha spring 275 is weakened after the paper discharge guide 24 is closed at the end of the previous job. In addition, examples of the case where the closing sensor S42 is not pressed by the detection claw 241 in ACT 716 include a case where the amount of the documents M stacked on the second tray 25 exceeds an acceptable level.

When the size of the document detected by the document size sensor S2 is the business card size (ACT 702, YES), as in the first embodiment, the tray detection sensor S3 detects whether or not the second tray 25 is set in the tray groove 231 (ACT 703). When the second tray 25 is not set in the tray groove 231 (ACT 703, NO), the control unit 28 continues the control until the tray detection sensor S3 detects the second tray 25. When the tray detection sensor S3 detects the second tray 25 (ACT 703, YES), the control unit 28 drives the rotation mechanism 27 (ACT 704).

When the paper discharge guide 24 is opened by the rotation mechanism 27 in ACT 704, unlike the first embodiment, the control unit 28 detects whether or not the opening sensor S41 is pressed (ACT 713). When the opening sensor S41 is not pressed (ACT 713, NO), the control unit 28 causes the operation screen 61 to display the second error screen 63 (refer to FIG. 11) showing that the paper discharge guide 24 is not completely opened (ACT 714). When the opening sensor S41 is pressed, the second error screen 63 is removed (ACT 715, YES). When the opening sensor S41 is not pressed (ACT 715, NO), the second error screen 63 is continuously displayed. When the opening sensor S41 is pressed (ACT 713, YES), the control unit 28 executes the job received by the main control unit 7 (ACT 705). Next, when the job does not end (ACT 706, NO), the control unit 28 continues the control. When the job ends (ACT 706, YES), the control unit 28 ends the driving of the rotation mechanism 27 (ACT 707).

Examples of the case where the opening sensor S41 is not pressed by the detection claw 241 include a case where the document is stacked on the first tray 23 and the detection claw 241 and the opening sensor S41 are separated from each other by the document such that the paper discharge guide 24 is not completely opened.

When the paper discharge guide 24 is closed by the rotation mechanism 27 in ACT 707, the control unit 28 proceeds to the process (ACT 716) of detecting whether or not the closing sensor S42 is pressed.

In the second embodiment, the opening and closing detection sensor S4 is provided in the first embodiment such that the job is prevented from being executed in a state where the paper discharge guide 24 has a defect during opening and closing. That is, the occurrence of paper clogging caused when a discharged paper comes into contact with the paper discharge guide 24 that is not completely opened or closed can be suppressed, and the mixing of the document M having a business card size and a document not having a business card size stacked on the paper discharge guide 24 can be suppressed.

Third Embodiment

The automatic document feeder 2 according to a third embodiment is different from that of the second embodiment, in that the rotation mechanism 27 does not include the solenoid 272 and the alpha spring 275. Regarding the respective components of the third embodiment in FIG. 13, the same components as those in the control block diagram of the second embodiment in FIG. 8 will be represented by the same reference numerals. Regarding the respective components of the third embodiment in FIG. 14, the same components as those in the control flowchart of the second embodiment in FIG. 10 will be represented by the same reference numerals.

Hardware configurations of the image forming apparatus 1 and the automatic document feeder 2 according to the third embodiment will be described with reference to FIG. 13.

Figure 13:
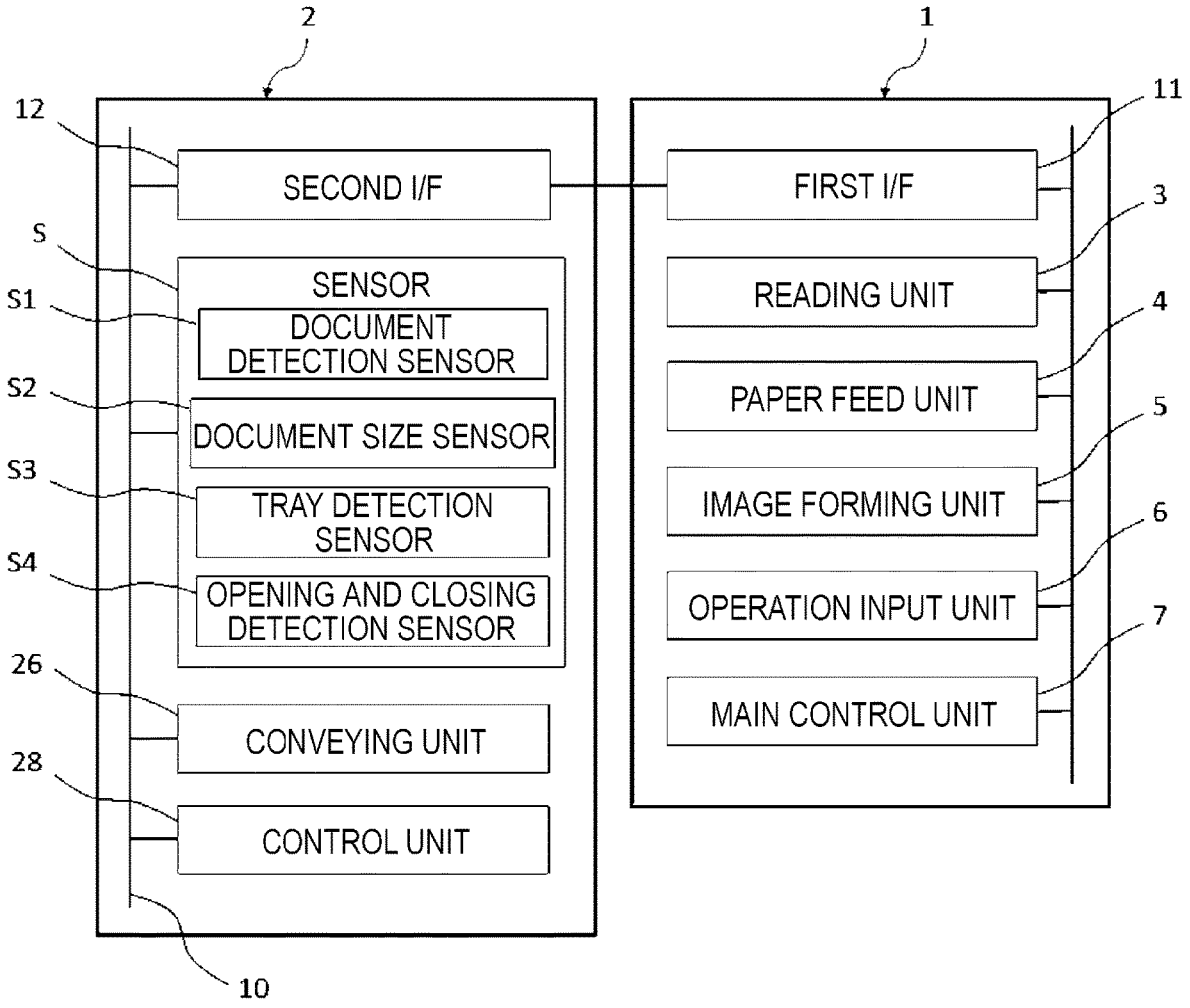
FIG. 13 is a control block diagram illustrating the image forming apparatus and the automatic document feeder according to a third embodiment.

FIG. 13 is a control block diagram illustrating the image forming apparatus 1 and the automatic document feeder 2 according to the third embodiment.

The third embodiment is different from the second embodiment, in that the rotation mechanism 27 is excluded from the configuration illustrated in FIG. 8.

The rotation mechanism 27 according to the third embodiment does not include an electrical driving mechanism such as the solenoid 272, and the opening and closing of the paper discharge guide 24 is not controlled by the control unit 28. Therefore, it is necessary that the user manually opens and closes the paper discharge guide.

Next, a control of the automatic document feeder 2 during execution of a job in the third embodiment will be described with reference to FIG. 14.

Figure 14:
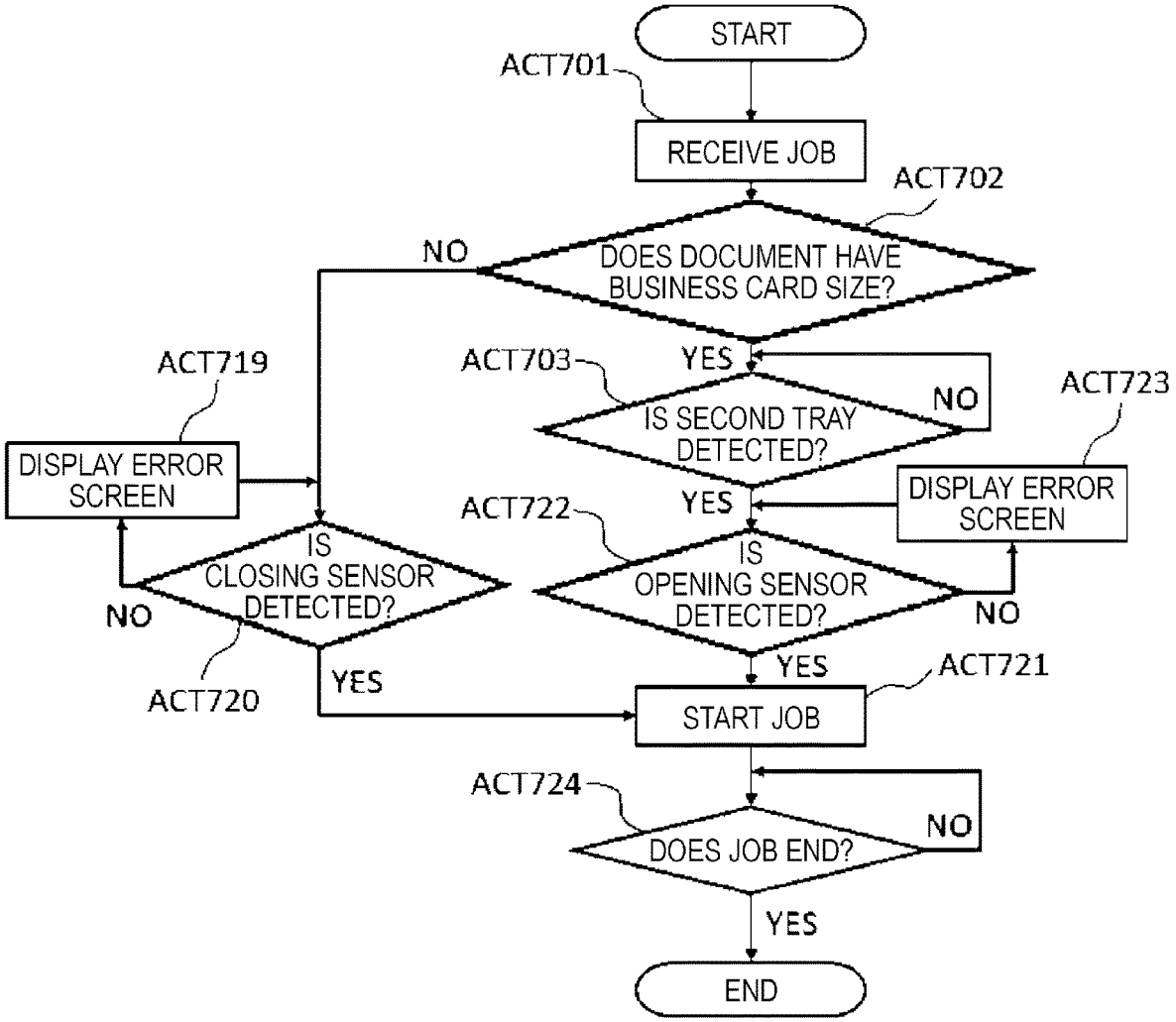
FIG. 14 is a control flowchart illustrating a reading process in the third embodiment.

FIG. 14 is a control flowchart illustrating a reading process in the third embodiment.

The third embodiment is different from the second embodiment, in that the control of the rotation mechanism 27 is excluded from the configuration illustrated in FIG. 10.

Since FIG. 14 illustrates the control process of the automatic document feeder 2 excluding the control of the rotation mechanism 27 for opening and closing the paper discharge guide 24, the description of the processes described using FIGS. 7 and 10 will not be repeated.

When the size of the document detected by the document size sensor S2 is not the business card size in ACT 702 (ACT 702, NO), the control unit 28 detects whether or not the closing sensor S42 is pressed (ACT 720). When the closing sensor S42 is not pressed (ACT 720, NO), the control unit 28 causes the operation screen 61 to display a screen for urging the user to execute the operation of closing the paper discharge guide 24 or the first error screen 62 (refer to FIG. 10) (ACT 719).

When the size of the document detected by the document size sensor S2 is the business card size in ACT 702 (ACT 702, YES) and the tray detection sensor S3 detects the second tray 25 in ACT 703, the control unit 28 detects whether or not the opening sensor S41 is pressed (ACT 722). When the opening sensor S41 is not pressed (ACT 722, NO), the control unit 28 causes the operation screen 61 to display a screen for urging the user to execute the operation of opening the paper discharge guide 24 or the second error screen 63 (refer to FIG. 11) (ACT 720).

In the third embodiment, in a place where the solenoid 272 is provided in the first embodiment and the second embodiment illustrated in FIG. 5B, an elastic body that applies a force in the d direction illustrated in FIG. 6A may be provided instead of the solenoid 272. The elastic body is, for example, a coil spring having a cylindrical shape and is provided in the connection portion 271 such that a force is applied in a compression direction of the coil spring.

The elastic body applies a force to the paper discharge guide 24 such that the detection claw 241 comes into contact with the opening sensor S41. Since the elastic body assists the opening of the paper discharge guide 24, the occurrence of a situation where the detection claw 241 is not in contact with the opening sensor S41 although the user opens the paper discharge guide 24 can be prevented.

When the elastic body is provided, it is necessary to provide a mechanism for supporting the state where the paper discharge guide 24 is closed. Examples of the mechanism for supporting the state where the paper discharge guide 24 is closed include a protrusion that interferes with the detection claw 241 to be fixed in a place of the first tray 23 where the detection claw 241 is stored. The stress of the protrusion that interferes with the detection claw 241 is set to be higher than the stress that is applied to the protrusion by the elastic body through the detection claw. That is, when the detection claw 241 interferes with the protrusion, the paper discharge guide 24 is not opened using a force of the elastic body.

The replacement of the solenoid is not limited to the elastic body and may be, for example, a weight as long as the weight applies a force in the d direction illustrated in FIG. 6A.

In the third embodiment, the same effects as those of the second embodiment can be obtained. However, the opening and closing of the paper discharge guide 24 according to the third embodiment is manually executed without depending on the control unit 28. Therefore, as compared to the second embodiment, the opening and closing of the paper discharge guide 24 is more likely to be forgotten, which is useful.

While certain embodiments have been described, these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such embodiments or modifications as would fall within the scope and spirit of the invention.

What is claimed is:

1. An automatic document feeder, comprising:

a conveying unit configured to convey a sheet to a path to and above a reading unit;

a first tray on which the sheet discharged by the conveying unit is stacked;

a storage unit provided below the first tray;

a discharge guide configured to guide the sheet discharged by the conveying unit to the storage unit; and a second tray storable in the storage unit, wherein the sheet having a predetermined size is stacked on the second tray, and wherein the second tray is drawable out from the storage unit in a direction intersecting a discharge direction of the sheet discharged by the conveying unit.

2. The automatic document feeder according to claim 1, wherein the sheet having a business card size is stacked on the second tray, and the second tray is drawable out from the storage unit in a direction intersecting a discharge direction of the sheet discharged by the conveying unit.

3. The automatic document feeder according to claim 1, wherein the discharge guide is openable and closable at a first position where the discharge guide opens the storage unit and a second position where the discharge guide covers the storage unit, respectively, and at the second position where the discharge guide covers the storage unit, the discharge guide is a part of a stacking surface of the first tray.

4. The automatic document feeder according to claim 1, wherein the second tray is smaller than the first tray.

5. The automatic document feeder according to claim 1, wherein the automatic document feeder is a dual scan document feeder.

6. The automatic document feeder according to claim 1, wherein the automatic document feeder is a reversing automatic document feeder.

7. An image processing apparatus, comprising:

a conveying unit configured to convey a sheet;

a first tray on which the sheet discharged by the conveying unit is stacked;

a storage unit provided below the first tray;

a discharge guide configured to be openable and closable at a first position where the discharge guide opens the storage unit and a second position where the discharge guide covers the storage unit, respectively;

an opening and closing detection sensor configured to detect the first position where the discharge guide opens the storage unit and the second position where the discharge guide covers the storage unit;

a display configured to display predetermined information; and a controller configured to cause the display to display a screen showing a defect regarding the opening and closing of the discharge guide based on a detection result of the opening and closing detection sensor.

8. The image processing apparatus according to claim 7, further comprising a second tray storable in the storage unit.

9. The image processing apparatus according to claim 8, wherein the sheet having a predetermined size is stacked on the second tray, and the second tray is drawable out from the storage unit in a direction intersecting a discharge direction of the sheet discharged by the conveying unit.

10. The image processing apparatus according to claim 8, wherein the sheet having a business card size is stacked on the second tray, and the second tray is drawable out from the storage unit in a direction intersecting a discharge direction of the sheet discharged by the conveying unit.

11. The image processing apparatus according to claim 8, wherein the second tray is smaller than the first tray.

12. The image processing apparatus according to claim 7, further comprising a dual scan document feeder.

13. The image processing apparatus according to claim 7, further comprising a reversing automatic document feeder.

14. A document processing method, comprising:

conveying a sheet;

stacking the sheet discharged by the conveying to a first tray;

detecting a first position where a discharge guide opens a storage unit provided below the first tray and a second position where the discharge guide covers the storage unit, wherein the discharge guide is configured to be openable and closable at the first position where the discharge guide opens the storage unit and the second position where the discharge guide covers the storage unit, respectively; and displaying a screen showing a defect regarding the opening and closing of the discharge guide based on a detection result.

15. The document processing method according to claim 14, wherein the storage unit has a second tray storable in the storage unit.

16. The document processing method according to claim 15, further comprising:

stacking a sheet having a predetermined size on the second tray, and moving the second tray out from the storage unit in a direction intersecting a discharge direction of the sheet discharged.

17. The document processing method according to claim 15, further comprising:

stacking a sheet having a business card size on the second tray, and moving the second tray out from the storage unit in a direction intersecting a discharge direction of the sheet discharged.

18. The document processing method according to claim 15, wherein the second tray is smaller than the first tray.

* * * * *